US007126474B2

(12) United States Patent
Ingram et al.

(10) Patent No.: US 7,126,474 B2
(45) Date of Patent: Oct. 24, 2006

(54) VENDING MACHINE WITH REMOTE CONTROL ALARM

(75) Inventors: James Larry Ingram, Pine Bluff, AR (US); Yefim Y. Fundyler, Little Rock, AR (US); Tony M. Goodwin, Whitehall, AR (US)

(73) Assignee: Fragramatics Manufacturing Co., Inc., Pine Bluff, AR (US)

( * ) Notice: Subject to any disclaimer, the term of this patent is extended or adjusted under 35 U.S.C. 154(b) by 202 days.

(21) Appl. No.: 10/974,994

(22) Filed: Oct. 28, 2004

(65) Prior Publication Data

US 2006/0097868 A1 May 11, 2006

(51) Int. Cl.
*G08B 10/08* (2006.01)

(52) U.S. Cl. ..... 340/545.6; 340/545.1; 340/521; 340/691.1; 340/691.4; 340/686.1; 116/86

(58) Field of Classification Search ..... 340/521, 340/522, 545.1, 566, 691.4, 691.5, 692, 568.8, 340/686.1
See application file for complete search history.

(56) References Cited

U.S. PATENT DOCUMENTS 3,561,395 A 2/1971 Piersma
3,852,737 A 12/1974 Gordon
4,117,465 A 9/1978 Timblin
4,876,532 A 10/1989 Sauls
5,091,713 A * 2/1992 Horne et al. ..... 340/541
5,884,807 A 3/1999 Yun
6,505,774 B1 * 1/2003 Fulcher et al. ..... 235/381

* cited by examiner

*Primary Examiner*—Jeffery Hofsass
*Assistant Examiner*—Hongmin Fan
(74) *Attorney, Agent, or Firm*—Stephen D. Carver

(57) ABSTRACT

An electronic alarm and a vending machine equipped with the alarm monitors a plurality of zones by suitable circuitry to detect vandalism and theft. Each zone has a mechanically-triggered sensor that provides an electrical output. The zones comprise a pair of door sensors and a separate, shock sensor. A solid-state logic circuit includes a red and green indicator light, and a loud warning buzzer ultimately triggered by the sensors. A circuit time delay and logic scheme analyzes sensor status, and separate false-alarm prevention circuits insure proper triggering after a predetermined delay. Alarm status is indicated by highly visible green and red status lights mounted on the door. A buzzer sounds in response to sensor activation and circuit logic. A back-up battery that is coupled to the logic circuitry for fail-safe operation includes an automatic recharge system, and dual red and green LED's monitor battery condition.

20 Claims, 11 Drawing Sheets

| | |
|---|---|
| Fig. 6 | Fig. 8 |
| Fig. 7 | Fig. 9 |

VENDING MACHINE WITH REMOTE CONTROL ALARM

BACKGROUND OF THE INVENTION

1. Field of the Invention

The present invention relates generally to vending machine alarm systems. More particularly, the present invention relates to alarm-equipped vending machines typically used at self-service car washes that are deployed in unattended locations, and which are subject to relatively high rates of vandalism and theft.

2. Description of the Related Art

Over the last several years, the self-service car wash industry has greatly modified the quality and quantity of products and services that are offered to customers. Many ancillary products such as vehicle waxes, detergents and other diverse items are sold from self-service "coin-operated" vending machines of diverse sizes, configurations and shapes that are usually mounted conveniently close to the washing bays. (As used herein the term "coin-operated" refers to self service vending machines that accept coins, credit cards, currency, tokens, or combinations thereof). Besides offering the consumer several cleaning options related to the vehicle exterior, typical self-service car wash installations offer a variety of products and choices relating to the vehicle interior. For example, numerous coin-operated suction-applying vacuuming systems exist. Various carpet cleaning and spot removal products are available for more vigorous interior cleaning. Various towels, dashboard cleaning solutions or preparations, various waxes, deodorants, and other diverse automotive items are typically stocked by well-equipped vending installation. Coin-operated vending machines that dispense fragrances and apply them to the vehicle interior are becoming relatively common.

In the self-service car wash industry most common coin-operated vending machines are installed outdoors at unattended locations. Of course, industry practice has been to mount the machines as safely and securely as possible within illuminated, high visibility areas. Often, custom-designed concrete "islands" are created at the carwash site specifically for mounting vending machines. Despite the advantages in security that result from specialized mounting designs, the risks of burglary and vandalism are ever-present. Most vending machines comprise a dollar-bill changer accessory, and a coin storage box. Many machine components are viciously mutilated when thieves smash their way through external components trying to break into these components. Although the burglary of money stored within vending machines is significant, the cost of physical damages inflicted upon vending machine structures by thieves during a theft often exceeds the amount of money stolen. As a result of such factors, burglary and/or intrusion warning systems designed specifically for vending machines have been proposed previously. However, known alarms suffer from many disadvantages.

Usually burglars try to pry open the vending machine door with a crow bar or other large lever, the use of which results in significant damages. Most of the alarms proposed to date are triggered by a switch at either the bottom or top of the door which is set off when the cabinet door, or a portion of the door, is deflected. However, if the burglar or vandal is attempting to pry open the door at a point below the latch, and if the alarm switch is above the latch, the alarm may not be triggered. Some alarms trigger only after significant structural damages are incurred by the machine. Many alarms require constant attention and complex maintenance by the proprietor. Some alarms are simply too difficult to set and reset. Most importantly, many common systems are prone to frequent, irritating false alarms.

SUMMARY OF THE INVENTION

Our unique alarm is adapted for installation within an upright cabinet associated with a typical vending machine. The alarm functions with conventional door designs, or with modern multi-point locking systems. A plurality of zones are monitored by the circuitry to detect vandalism and attempted theft. In the preferred mode, each zone includes a suitable sensor that responds to mechanical inputs and provides an electrical output. Preferably the sensors comprise a pair of door monitors and a separate, vibration or shock sensor. A solid-state monitoring circuit carefully analyzes the status of the sensors, providing two separate false-alarm prevention circuits. If conditions warrant it, an alarm is generated in response to the sensors after a predetermined delay time expires.

Alarm status is preferably indicated by a green status light and a separate red status light mounted on the machine front (i.e., upon the door or the cabinet). Both status lights are highly visible, so that an attendant need not exit his vehicle when inspecting an installation. Alarm states include an "Idle Mode", an "Armed Mode," and a "Detected Mode." In the idle mode service or maintenance may occur, as the alarm is disarmed. Most of the time the alarm assumes the "armed mode" and guards against vandalism or theft. In response to an intrusion the detected mode is enabled, and audio and visual warnings occur.

The circuit includes a buzzer that is activated by the combination of sensor activation and circuit logic. A back-up battery is coupled to the logic circuitry for fail-safe operation. Means are provided to automatically charge the battery, and dual red and green LED's driven by voltage sensing circuitry indicate battery condition.

The alarm preferably comprises a receiver that responds to a portable key-fob unit that an attendant may carry. A separate internal transmitter can remotely relay "detected mode" alarm conditions and status to a central location, but means are provided for relaying warnings via direct wire where required.

Thus, a basic object of the invention is to provide a highly sensitive, but intelligent, alarm system suitable for use with modern, self-service car wash vending machines.

Similarly, it is an object to provide a secure, alarm-equipped vending machine for vending automotive car-wash products, including vacuum, fragrances, cleaning solutions, and the like.

It is also a basic object is to provide a reliable alarm system ideal for car wash vending machines that sit alone in unattended, dimly lit locations that are subject to relatively high vandalism rates.

Furthermore, it is an important object to provide an audio-visual indication system for an alarm and a vending machine equipped with such an alarm, emulating the type of alarms used in modern vehicles. Specifically, it is a feature of the alarm that a blinking red light indicates that the alarm is properly set and protecting the machine.

Another basic object is to provide a car-wash vending machine that is difficult to successfully vandalize or burglarize.

A related object is to provide a vending machine alarm system that recognizes minor jolts or bumps during normal machine operations. It is a feature of the invention that the alarm will not respond to minor, ordinary vibrations of the type encountered in normal use.

Another object is to provide a vending machine alarm that can be user-set and reset with a minimum of inconvenience.

Another object is to provide an alarm system of the character described that allows a proprietor to drive through an installation with multiple alarm-equipped machines and quickly determine the status of each.

Yet another object is to provide an alarm of the character described, and a vending machine equipped with such an alarm, that unambiguously and reliably displays its status. It is a feature of our invention that flashing lights, that may be visually inspected by an attendant as he or she simply drives by the vending machine, brightly indicate the alarm state.

Another important object is to provide an alarm of the character described with an intelligence capability that enables the alarm to recognize desired alarm signals indicating theft, vandalism, unauthorized machine movements and the like.

It is also an important option to provide an alarm of the character described with a battery recharging system, and a means for warning the attendant or service personnel about the state of the battery and alarm recharging circuitry.

Another important object is to provide a transmitter and receiver means for vending machine alarms that enables the alarm to communicate remotely.

It is also an important object to provide a vending machine of the character described that is ideally adapted for car wash installations and which is relatively easily serviced.

Another object of my invention is to provide an alarm system of the character described that may be advantageously employed in conjunction with a variety of coin-operated vending machines and applicator systems.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
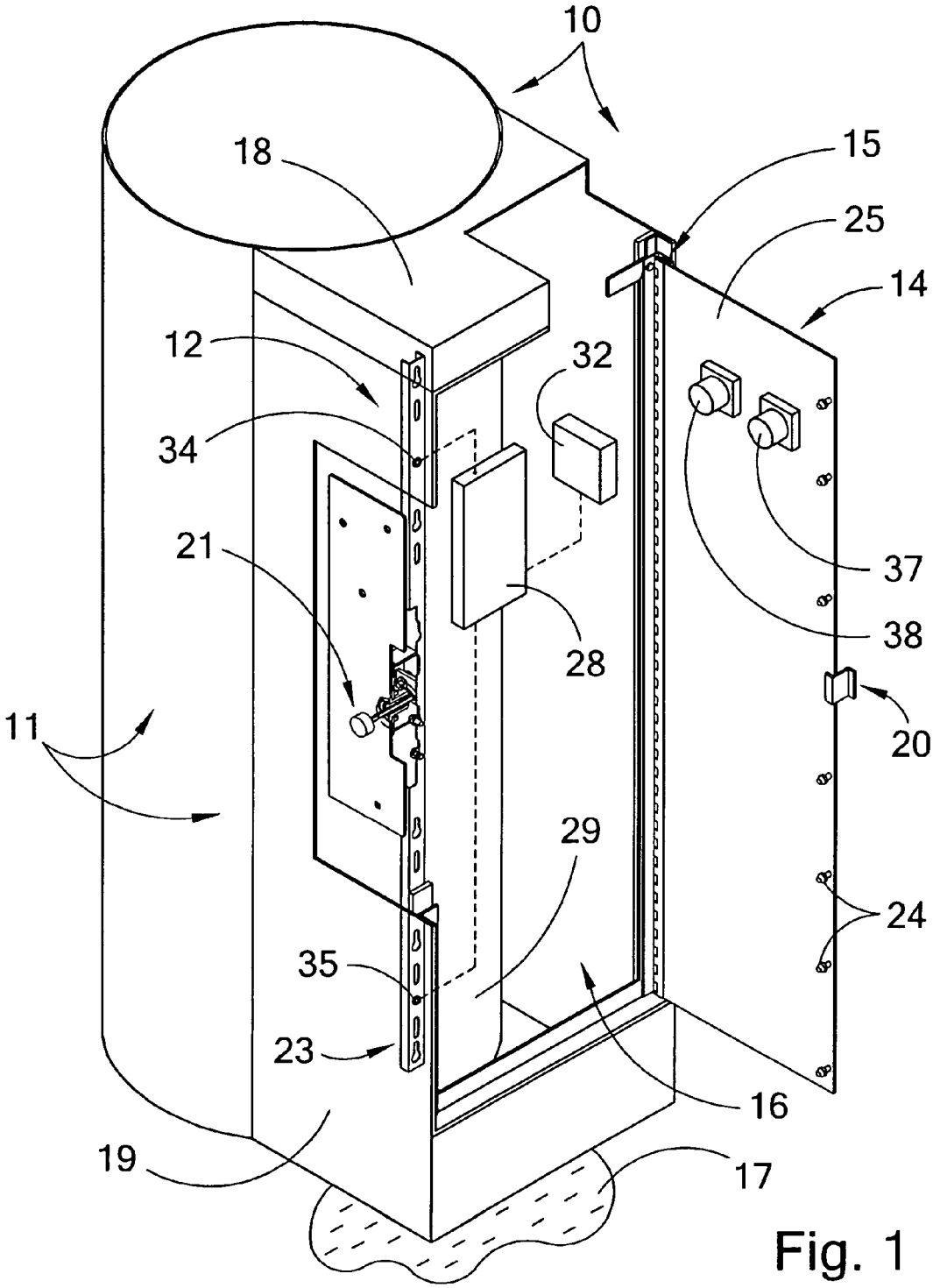
FIG. 1 is a fragmentary isometric view of a vending machine equipped with our alarm unit.
Figure 2:
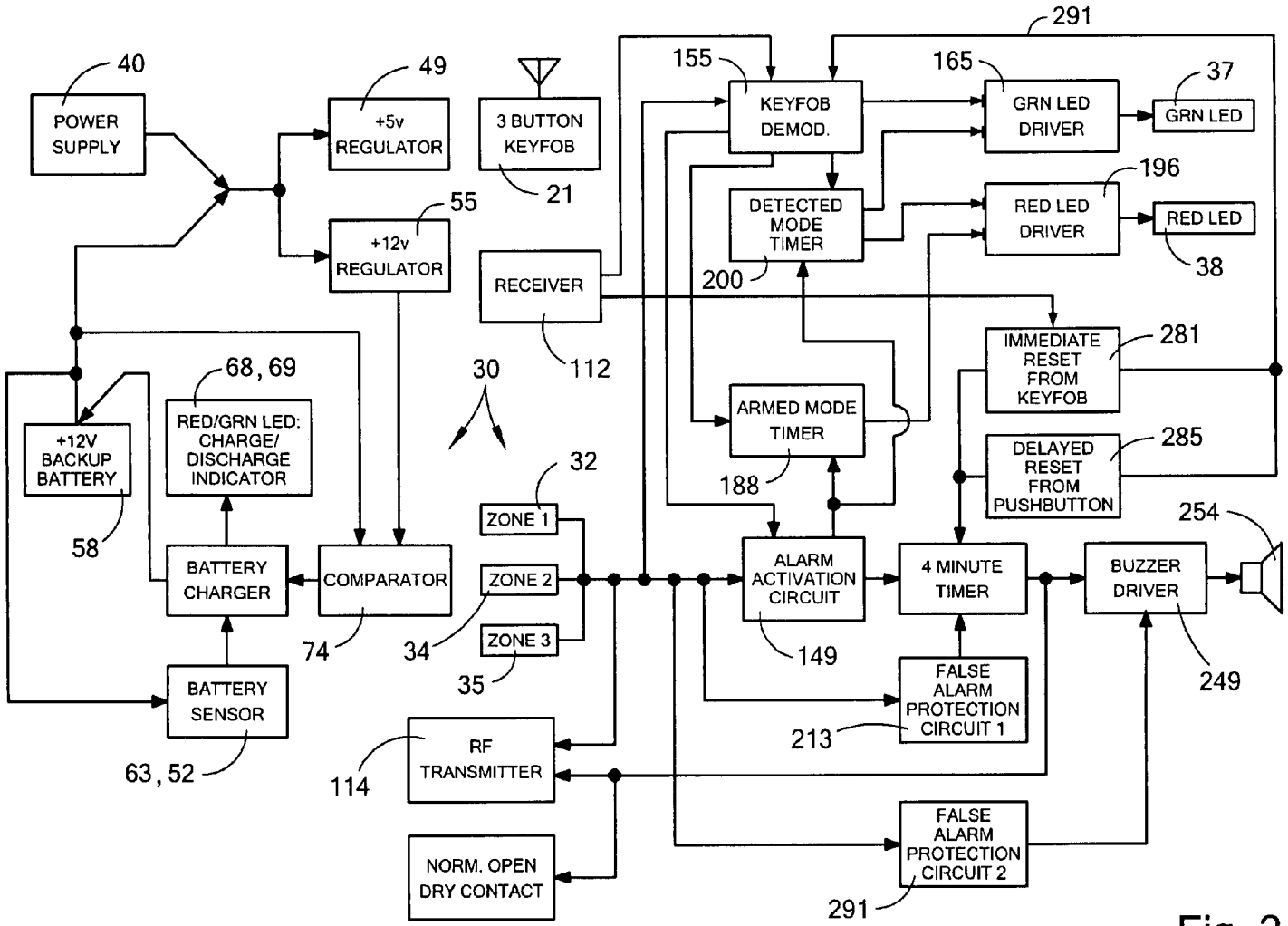
FIG. 2 is a block diagram of the preferred alarm system.

With initial reference now directed to FIGS. 1 and 2 of the appended drawings, the preferred vending machine has been generally designated by the reference numeral 10. It will be appreciated at the onset that the vending machine may be employed to vend a variety of products, and it may include a variety of internal parts, shelves, dispenser arrangements, coin-acceptors, dollar-bill acceptors or other typical accessories and features that are known to those skilled in the art. Vending machine 10 comprises a rigid, upright, cabinet 11 preferably made of stainless steel. The cabinet is normally disposed upon a suitable supporting surface 17 (FIG. 1), which preferably is provided by a suitable, elevated outdoor pedestal mounting of conventional design. Plumbing and electrical connections necessary for vending machines of this genre will be available proximate the mounting island, and often they are wired through the island into the interior volume 16 of the vending machine, as recognized by those skilled in the art.

The machine cabinet may be sized and shaped as desired. The illustrated cabinet 11 comprises a separate, frontal section 12 shaped generally like a parallelepiped that is associated with a somewhat cylindrical rear. Alternatively the entire cabinet may be in the form of a parallelepiped. A large, generally rectangular front door 14 is mounted to front section 12 with an elongated hinge 15. The cabinet 11 has a top 18 and sides 19 that surround cabinet interior volume 16. When door 14 is closed, the cabinet interior volume 16 will be substantially sealed and protected from the outside environment. As will be recognized by those skilled in the art, a variety of conventional vending machine equipment and components (i.e., such as power supplies, pumps, timers, circuit boards, fuses, wiring etc.) will be protectively housed within interior volume 16. In some designs, various quantities of physical products to be vended will be stored within interior volume 16 as well.

As a preliminary security measure the preferred compound hinge structure 15 enables the door 14 to nest, when closed, within a protective, recessed region of the cabinet offset from the frontal edges of the machine top 18 and sides 19. The latter construction minimizes machine susceptibility to prying. The hinged front door 14 is manually manipulated during service by a handle 20. The door 14 is released by a key 21 that moves locking channel section 23. Preferably, multi-point locking is established by channel 23 that is engaged by the multiple door locking pins 24 (FIG. 1) projecting from the door's inner surface 25. This preferred multi-point locking structure is described in co-pending application owned by the same assignee as this case, entitled "Vending Machine Cabinetry With Security Locked Double Hinged Door," Ser. No. 10/857,078, filed May 28, 2004, which, for purposes of disclosure, is hereby incorporated by reference. Of course it is to be understood that our alarm is intended for use with other vending machine configurations and designs as well, and is not limited to multi-point locking systems.

Alarm 28 is securely mounted within the machine cabinet 11 upon a suitable interior panel 29 or other mechanical support. The preferred peripheral circuitry 30 is illustrated in block form in FIG. 2. As described further below, alarm 28 monitors and responds to a plurality of separate "zones," preferably three. The first zone comprises as internal, normally-closed vibration or shock sensor 32 mounted within the cabinet interior volume 16. Sensor 32 opens only when it senses shock. The two other "zones" monitored by alarm 28 are a pair of normally-open mechanically or magnetically operated door sensors 34 and 35. These sensors 34 and 35 are preferably mounted to contact the door 14 (FIG. 1) when it is closed. When the door 14 is closed, sensors 34 and 35 "close" to complete a circuit through them. Alarm status is preferably indicated by a green status light 37 (FIGS. 1, 2) and a separate red status light 38 mounted atop door interior surface 25. Status lights 37, and 38 preferably comprise LED's. Both are visible from the front of the door or cabinet, once the door is shut, the vending machine is switched "on," and the alarm is turned "on" and then appropriately "armed."

The alarm 28 may assume three separate states of operation, an "Idle Mode", an "Armed Mode," and a "Detected Mode," that are explained in detail hereinafter. In the idle mode the alarm is disarmed, and service or maintenance activities are possible, as the alarm does not respond to a disturbance. In the "armed mode" the alarm monitors potential vandalism or theft activities or other disturbances to the vending machine, all of which are collectively referred to herein as intrusions, and circuitry to be described processes derived intrusion information. In the detected mode, detection circuitry has confirmed a proper intrusion, the alarm has been triggered, and audio and visual signals are provided. In the idle mode when the alarm is disarmed, a "Disarmed" status is indicated by a steady green light (i.e., status light 37). The alarm logic circuitry is discussed hereinafter in detail. Preferred alarm conditions indicated by the status lights 37, 38 (FIG. 3) are as follows:

TABLE 1

Status of Installed Alarm vs. Indicator light condition

| Alarm Condition | Red light status | Green light status |
|---|---|---|
| Idle Mode, "On" but disarmed | Off | Steady On, machine service OK |
| Machine "armed" | On and Blinking | Off |
| Detected Mode (Alarm activated and tripped) | On and Fast Blinking | On and Fast Blinking |

Figure 3:
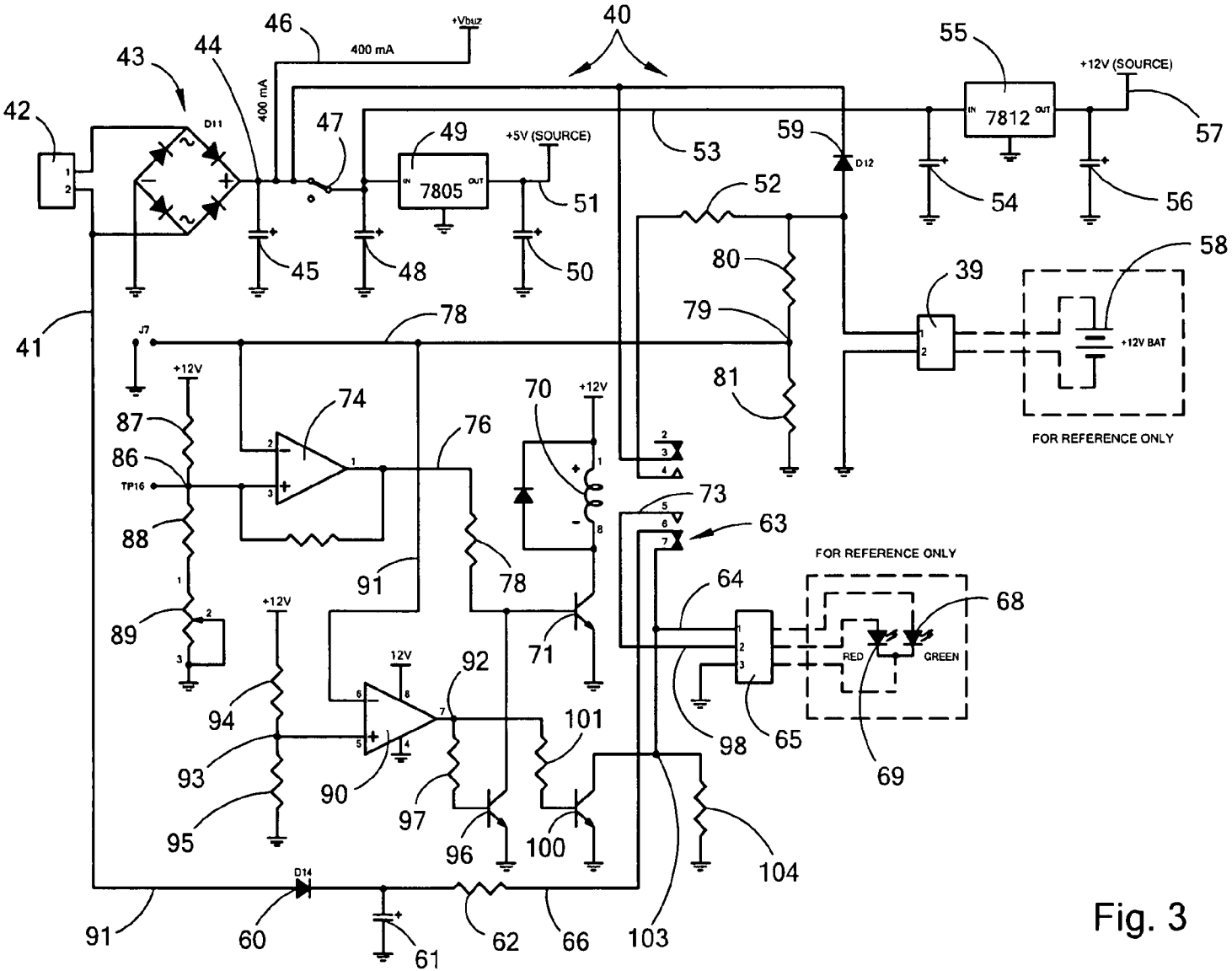
FIG. 3 is an electrical schematic diagram of the preferred power supply and battery recharging circuit.
Figure 7:
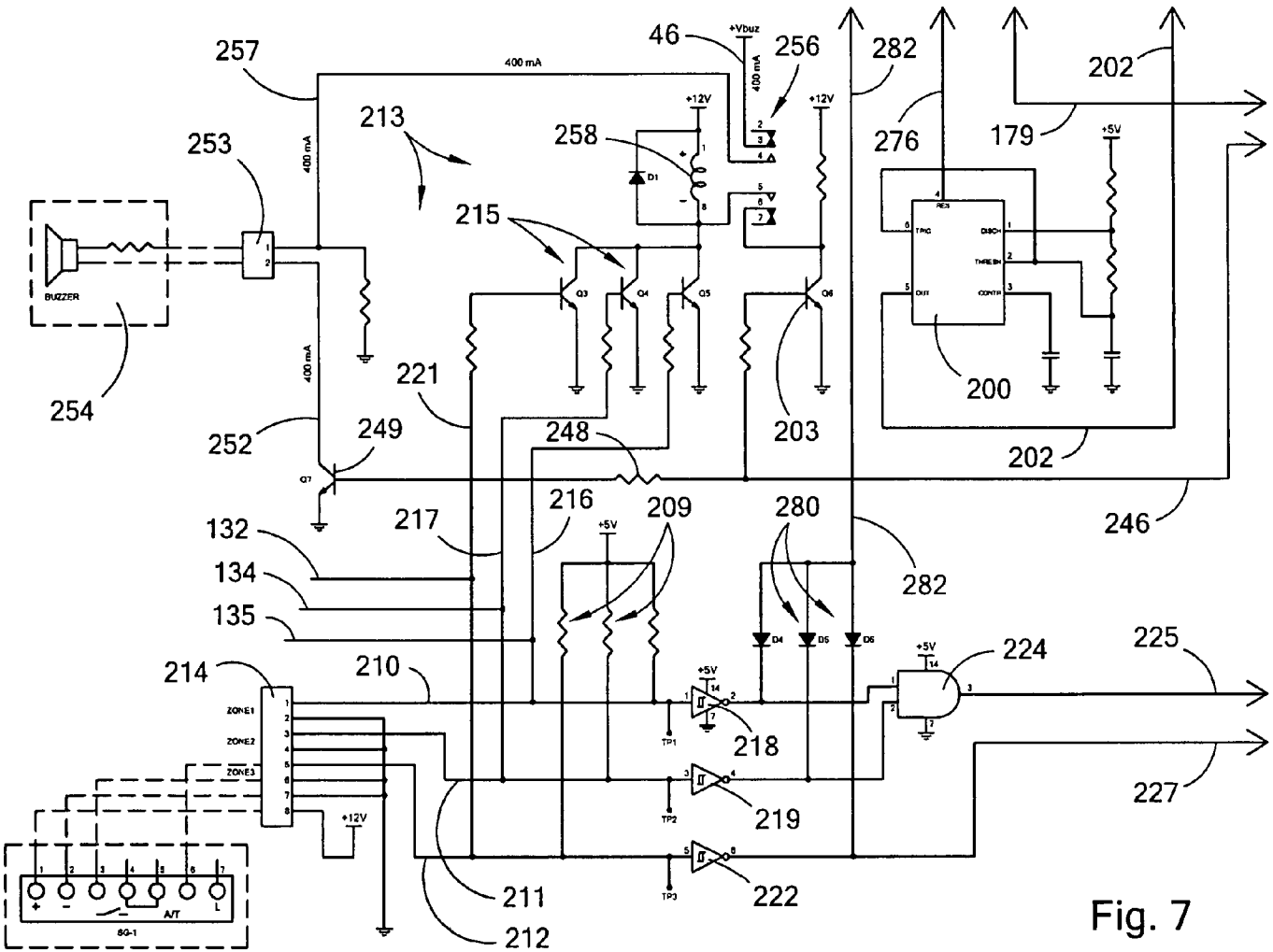

With joint reference now directed to FIGS. 2 and 3, a battery-backed up power supply has been generally designated by the reference numeral 40. Connector 42 applies twelve volt rms A.C. voltage across diode rectifier bridge 43 that outputs approximately sixteen volts D.C. to line 46 at node 44 across filter capacitor 45. Line 46 (FIGS. 3, 7) delivers voltage to a remote buzzer 254 (FIG. 7). Voltage is delivered through jumper 47 to optional filter capacitor 48 and regulator IC 49 (i.e., a 7805 chip) that outputs regulated five volts D.C. across filter capacitor 50 to line 51, which runs to the various +5 volt devices. Line 53 connects optional filter capacitor 54 and regulator IC 55 (i.e., a 7812 chip) to the unregulated sixteen volts D.C. appearing at node 44. Regulator 55 outputs across filter capacitor 56 to +12 volt D.C. source line 57.

A back-up battery 58 is coupled via back-biased diode 59 to node 44 to power the alarm when no A.C. power is available from connector 42. Battery 58 is physically remote from the alarm unit and it is interconnected to the power supply circuitry 40 with connector 39. Preferably the battery is secured within the vending machine cabinet. Means are provided to charge battery 58, and a charge indicator comprising a green LED 68 and a red LED 69 (FIG. 3) is provided to monitor its status. Line 41 from connector 42 (FIG. 3) leads to half-wave rectifier diode 60, filter capacitor 61, and series resistor 62 to pin 6 of electrical relay 63 that leads via line 64 and interface 65 to a green LED 68. Relay contact 6 connects to contact 7 during normal operation so that green LED 68 is normally activated to indicate that battery 58 is fully charged. The companion red LED 69 is activated on line 73 when relay contact 6 connects to contact 5 to indicate that the backup battery 58 is charging.

There are two battery voltage monitoring systems (FIG. 3) for controlling recharge operations. Battery voltage is monitored and compared to two reference points via comparators; the first comparator determines when the battery voltage has dropped and recharging is necessary; the second comparator determines when voltage is so low that recharging is unsafe. A recharging circuit uses comparator 74 and a companion recharge-prevention circuit uses comparator 90. The recharge circuit comprises relay 63 (FIG. 3) which can be activated by switching transistor 71 that energizes relay coil 70 to recharge battery 58 by closing relay contacts 3 and 4, so current through resistor 52 trickle charges battery 58. When the battery 58 is not being recharged, relay contacts 6 and 7 are connected, and contacts 2 and 3 are connected (FIG. 3). Transistor 71 can be switched "on" by comparator 74 via resistor 78 and line 76. With transistor 71 "on," relay contacts 3 and 4 are connected, and contacts 5 and 6 are connected. Pin 2 of comparator 74 is connected via line 78 to node 79 at the junction of voltage divider resistors 80 and 81 that are connected across battery 58, to monitor battery voltage. Pin 3 of comparator 74 connects to node 86 at the junction of divider resistors 87 and 88 that are connected to variable resistor 89, which can adjust the reference voltage appearing at node 86 to approximately 7.97 volts. Comparator 74 seeks to enable recharging when the battery voltage, preferably 13.5 volts, drops too low at node 79.

The recharge prevention circuit (FIG. 3) assumes that the battery cannot be trickle charged, but must instead be replaced or recharged by a high amperage external charger, if battery voltage drops beneath approximately 10.5 volts. In the recharge prevention circuit, pin 6 of comparator 90 (FIG. 3) is similarly connected via line 91 to line 78 to derive battery voltage reading. Pin 5 of comparator 90 leads to a resistance divider node 93 between resistors 94, and 95 to establish a reference voltage. If battery voltage is too low, comparator 90 turns on transistor 96 via node 92 and resistor 97 to turn off transistor 71. With transistor 71 "off", relay coil 70 is "off" and the relay 63 is unswitched. Relay contacts 3 and 4 are disconnected so trickle charging through resistor 52 stops.

Charging status is indicated by LED's 68, 69 (FIG. 3). When relay contacts 5 and 6 are connected by activation of transistor 71 during battery charging, red LED 69 is "on" via line 98, that is thus interconnected to power via resistor 62. If battery voltage is acceptable to comparator 74, and recharging is unnecessary, the green LED 68 will be "on," powered via line 66 (FIG. 3). If the recharge prevention circuit is activated, i.e., comparator 90 is outputting at node 92, transistor 100 is switched "on" via resistor 101 so the voltage at node 103 across resistor 104 goes low, turning off green LED 68.

Figure 4:
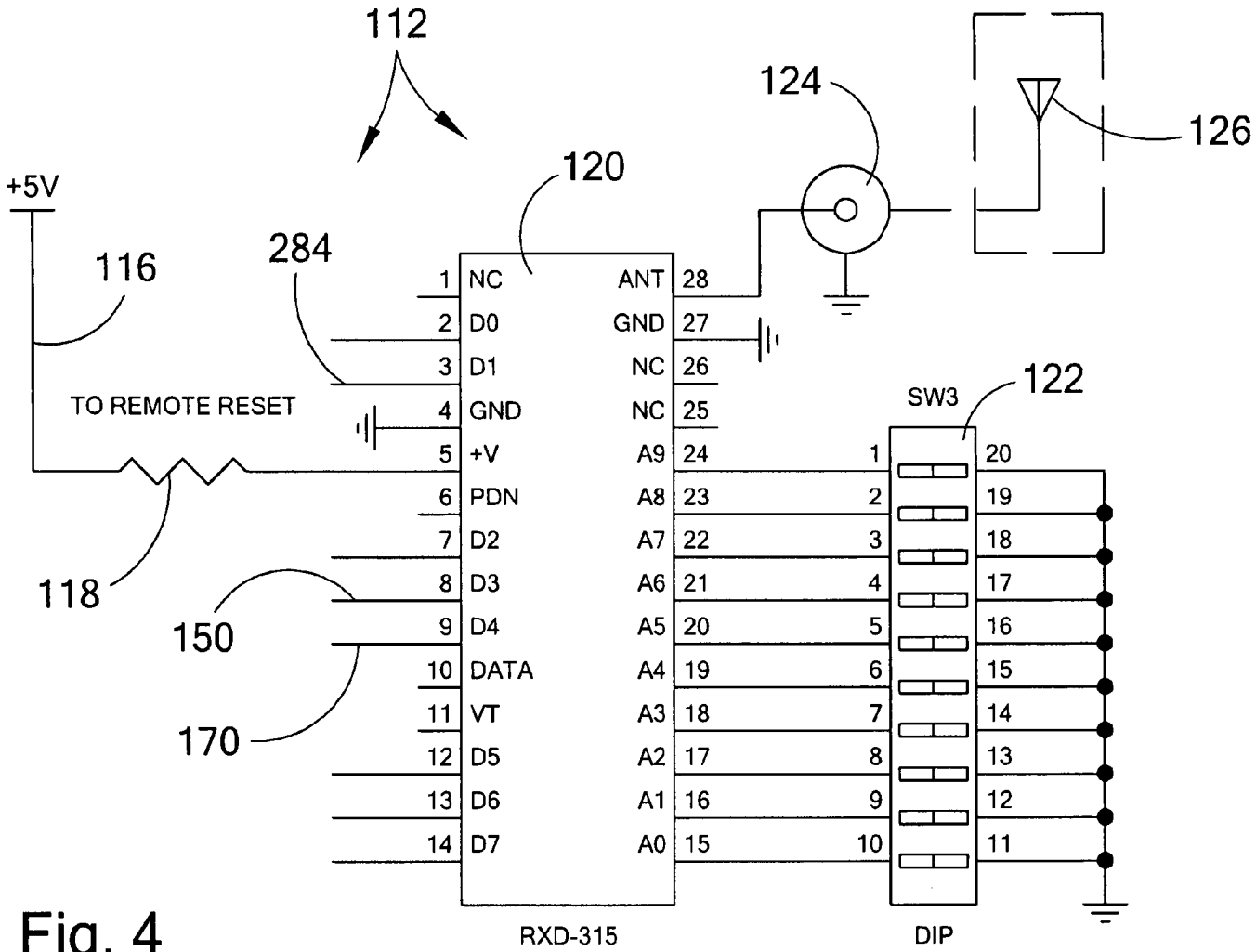
FIG. 4 is a block diagram of the preferred receiver integrated into the alarm.
Figure 5:
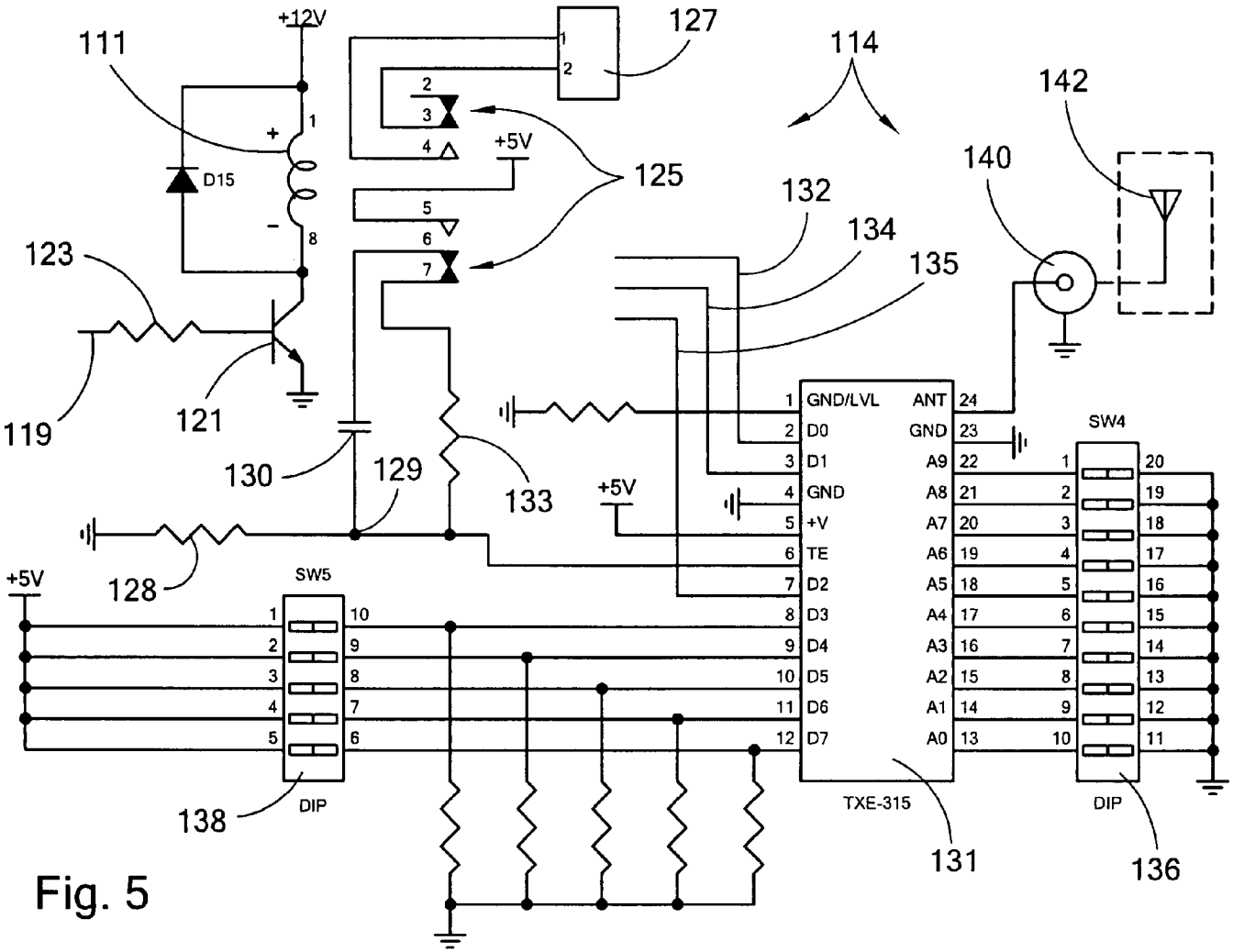
FIG. 5 is an electrical schematic diagram of the preferred transmitter that is integrated into the alarm.

Referencing primarily FIGS. 2, 4 and 5, the alarm portion of vending machine 10 preferably comprises a receiver 112 (FIGS. 2, 4), and a separate transmitter 114 (FIGS. 2, 5). Receiver 112 responds to remote transmitter key fob 21 (FIG. 2), enabling remote control of the alarm. Transmitter module 114 transmits alarm "detected mode" status remotely, either though radio transmission or by direct wire or both.

Figures 10, 12:
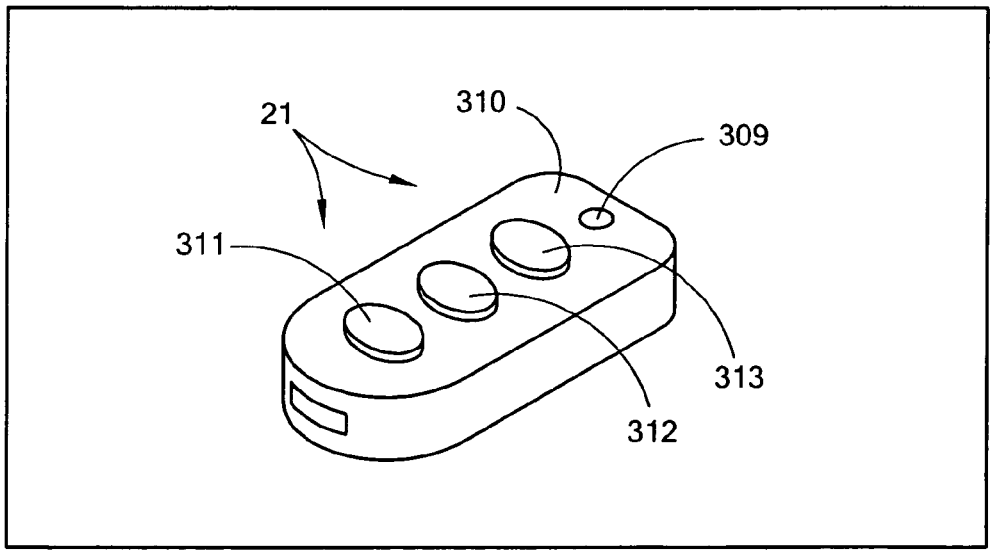
FIG. 10 is a diagrammatic view illustrating how FIGS. 6–9 should be positioned for viewing.

The receiver module (FIG. 4) responds to key fob 21 (FIGS. 2, 12), which is a small, portable unit with built-in authentication mechanisms for security, which is operated by three simple push-buttons described later. Power to the receiver module 112 (FIG. 4) appearing on line 116, which is coupled to +5 volts via line 51 (FIG. 3), is delivered via resistor 118 to pin 5 of the receiver IC 120. Chip 120 is a Linx Technologies RXD-315 encodable receiver integrated circuit, and it is programmed by DIP switch 122 that interconnects with chip pins 15–24 (FIG. 4) for addressing; i.e., switch 122 matches IC 120 for use with a given key fob 21 (FIG. 2). Pin 28 of receiver IC 120 (FIG. 4) receives RF energy from jack 124 that is connected to antenna 126. Pin 3 of receiver IC 120 (i.e., labeled "D1" in FIG. 4) resets the alarm on line 284 (FIGS. 4, 8) in response to a key fob-transmitted remote signal if it goes high. Pin 8 (i.e., "D3") via line 150 (FIGS. 4, 6) turns the green indicator status light 37 (FIGS. 1, 2) "on" during the idle mode. Pin 9 (i.e., D4) outputs on line 170 (FIGS. 4, 6) to activate the red status light 38 (FIGS. 1, 2) during the "armed" mode.

The transmitter module 114 (FIG. 5) responds to a signal on line 119 (FIGS. 5, 9) from pin 3 of timer 239 (FIG. 9) described hereinafter. The signal on line 119 reaches transistor 121 through resistor 123, energizing coil 111 of relay 125. Relay contact 3 connects with terminal 127 (FIG. 5). Relay contacts 5 and 6 interconnect an R/C timing circuit formed by resistor 128 and capacitor 130, that connect at node, pin 6 leading to pin 6 of transmitter IC 131. Resistor 133 discharges capacitor 130. Preferably the programmable transmitter IC 131 comprises a Linx Technologies model TXE-315. Sensors 32, 34, and 35 (FIG. 1) are respectively connected to pins 2, 3, and 7 of IC 131 via connector 214 (FIG. 7) via lines 210, 211, 212 connected to lines 135, 134, and 132 respectively that connect to pins 7, 3, and 2 respectively of transmitter IC 131 (FIG. 5). DIP switch 136 connects to pins 13–22 of transmitter IC 131 for unique addressing. These settings must be different from the receiver settings established by DIP switch 122 (FIG. 4). DIP switch 138 connected to pins 8–12 of IC 131 (FIG. 5) encodes data from IC 131 to identify a particular alarm unit. In this manner multiple alarm units may be used within a given location; the attendant for example, can determine which unit within a group of units at a particular installation was vandalized.

Figure 6:
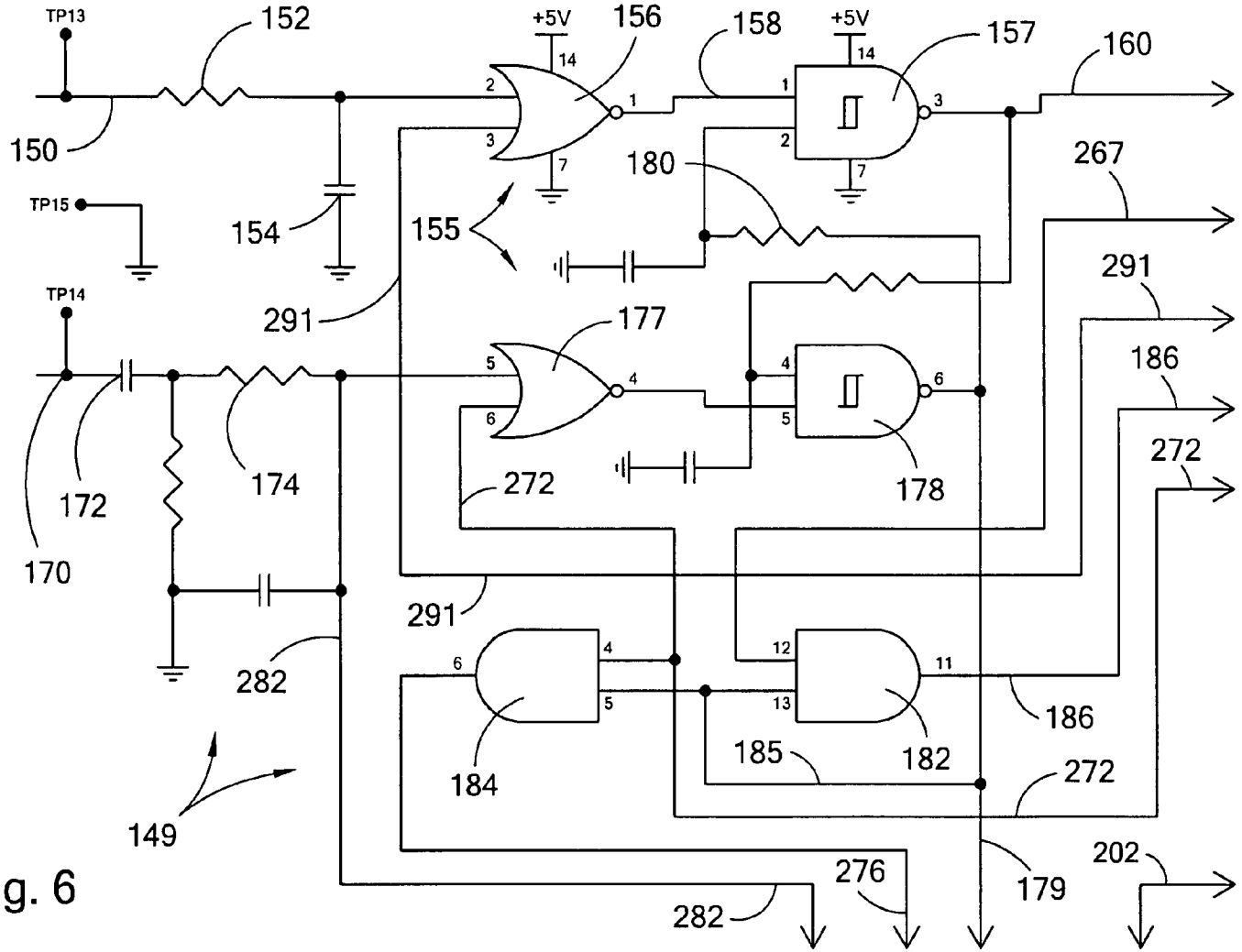
FIGS. 6–9 together form an electrical schematic of the preferred alarm circuit.

With joint reference now directed to FIGS. 6–9 (which should be arranged for viewing as in FIG. 10), the alarm activation circuit has been generally designated by the reference numeral 149. The receiver IC 120 (FIG. 4) outputs to a key fob demodulator, generally designated by the reference numeral 155 (FIGS. 2, 6). Receiver control from pin 8 of IC 120 (FIG. 4) is applied to line 150 and resistor 152 across capacitor 154 to pin 2 of NOR gate 156 (FIG. 6). Gate 156 outputs to NAND gate 157 via line 158. Gate 157 drives NAND gate 161 (FIG. 8) via line 160. Gate 161 outputs on line 162 to NAND gate 163 that activates transistor 165. The green status light 37 (i.e., actually an LED) discussed previously is activated when transistor 165 turns "on." As seen at the upper right of FIG. 8, the LED anode is connected via resistor 167 and connector 168 to +5 volts; the cathode end is in effect grounded by transistor 165. When green status light 37 is illuminated it means that the alarm is disarmed.

Receiver IC 120 (FIG. 4) also activates the red status indicator or LED 38 (FIG. 8) to show that the alarm is "armed." Pin 9 of receiver IC 120 (FIG. 4) outputs to line 170 (FIGS. 5 4, 6) through capacitor 172 and resistor 174 to activate NOR gate 177 that is coupled to NAND gate 178. The output of NAND gate 178 on line 179 reaches pin 2 of NAND gate 157 through resistor 180, causing a chain reaction through NAND gates 161, 163 and transistor 165 to turn off green LED 37.

Figure 8:
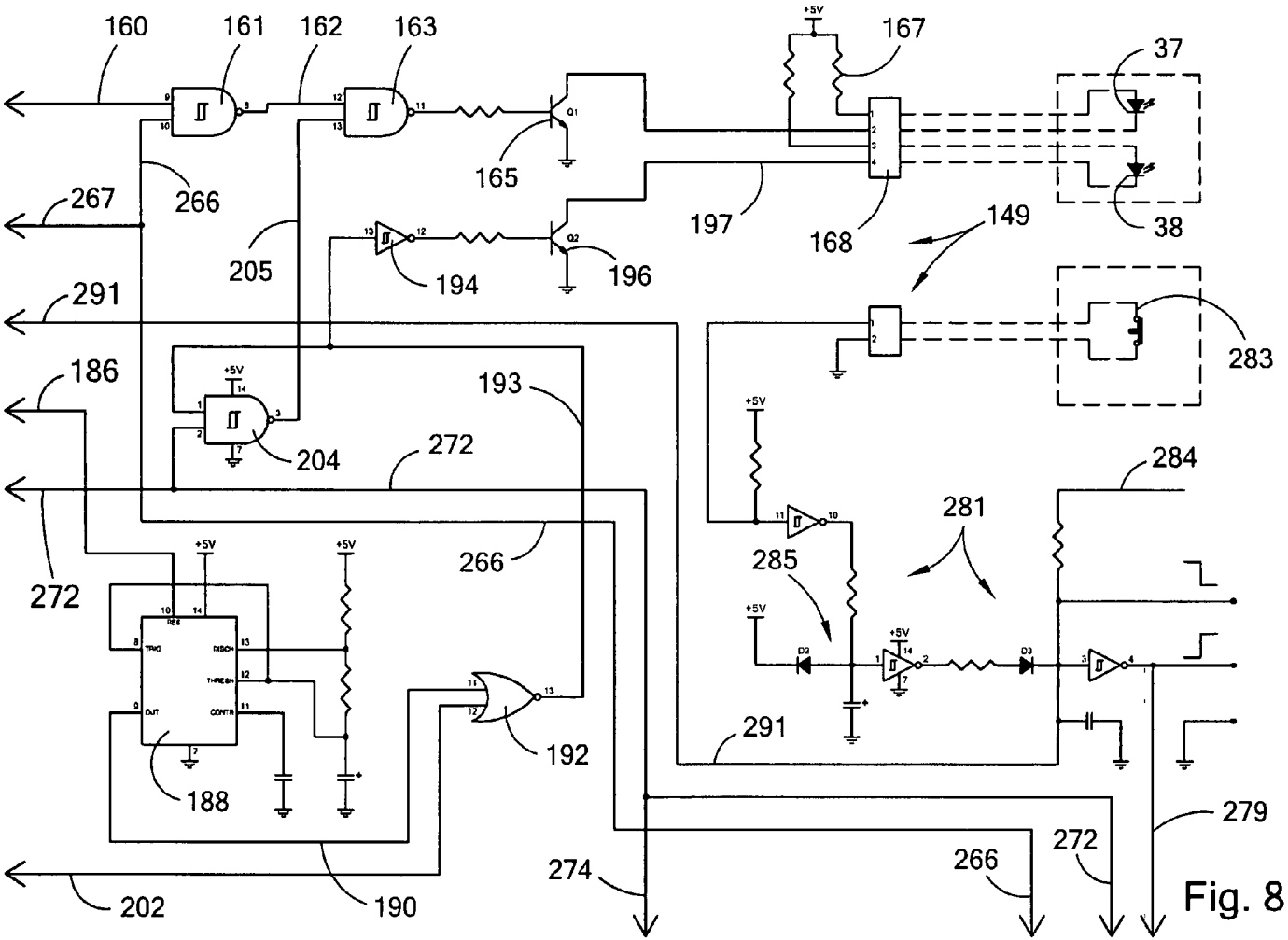

Line 179 (FIG. 6) also connects to pin 13 of AND gate 182 and pin 5 of AND gate 184 via line 185. Gate 182 outputs on line 186 that is applied to an "armed mode" timer 188 (FIG. 8). Pin 9 of timer 188 outputs on line 190 to NOR gate 192 that outputs on line 193 and reaches inverter 194 (FIG. 8). Driver transistor 196, which is controlled by inverter 194, activates the red LED status indicator 38 via line 197 and connector 168. Flashing of the red LED 38 as per Table 1, above, results from control exercised by timer 188. However, when the alarm is triggered, during, for example, a burglary, both indicator lights or LED's 37 and 38 are quickly flashed. Pin 5 of timer 200 (FIG. 7), that is similar to timer 188, outputs on line 202 (FIGS. 7, 8) and reaches pin 12 of NOR gate 192 (FIG. 8). Timers 188 and 200 result from a dual LM556 timer. Timer 188 (FIG. 8) is the "armed mode" timer and timer 200 (FIG. 7) is the "detected mode" timer.

NOR gate 192 (FIG. 8) outputs on line 193 which reaches pin 1 of NAND gate 204 which outputs in the detected mode only on line 205 to reach pin 13 of NAND gate 163. As previously explained, gate 163 controls driver transistor 165 that activates green indicator LED 37. As a result, the green status light (FIGS. 1, 8) is flashed at the opposite phase of the red LED to provide a dramatic visual intrusion warning.

Figure 9:
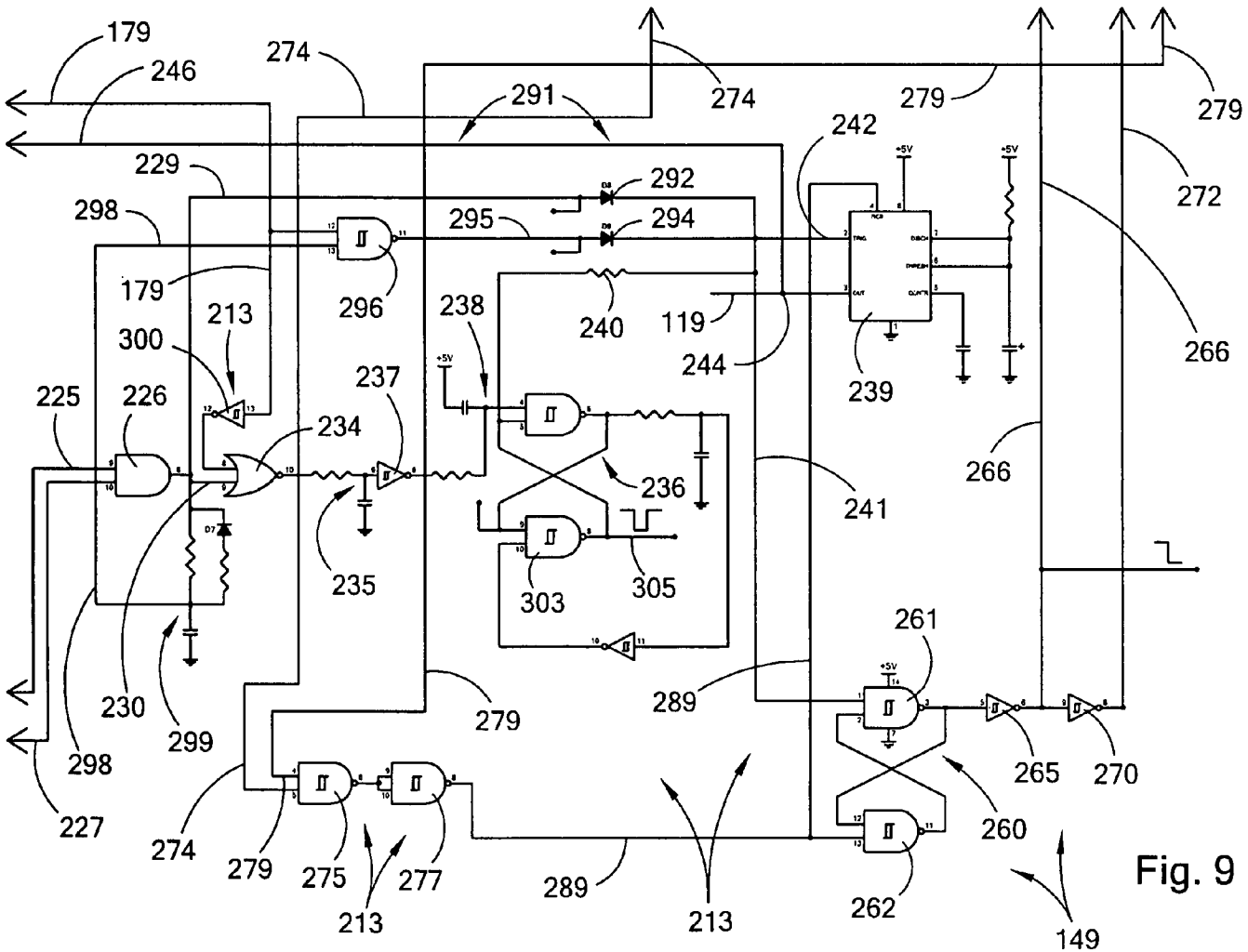
Figure 11:
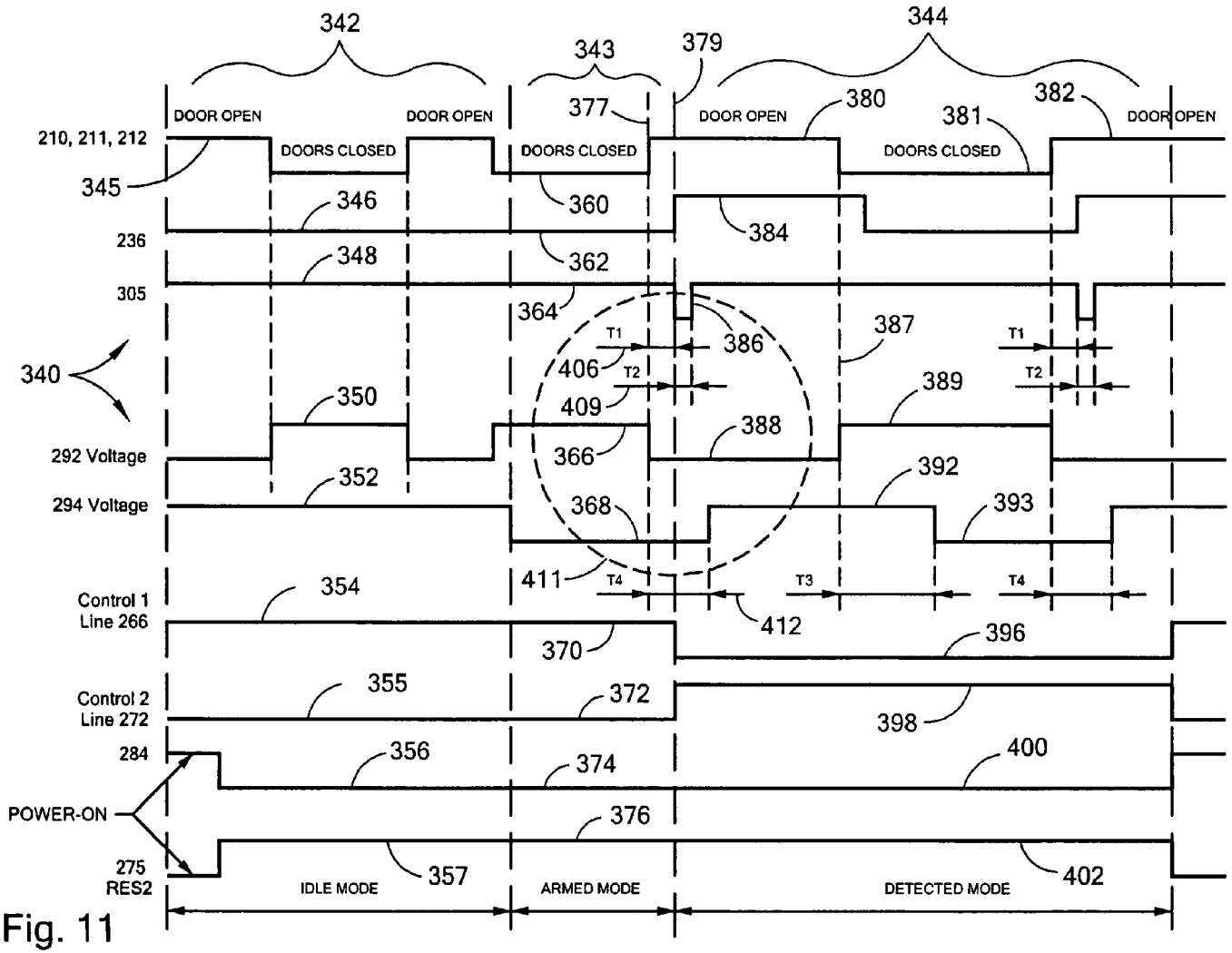
FIG. 11 is an electronic timing diagram of the preferred alarm circuit showing various signals that are generated within the circuit revealed in FIGS. 6–9; and, FIG. 12 is a pictorial view of the preferred remote control key-fob.

Various "zones" or portions of a vending machine may be monitored by the alarm. These have been generically designated as "zone 1", "zone 2," and "zone 3" in FIG. 2, corresponding in the best mode to door sensors 34, 35 (FIG. 1), and vibration sensor 32. It should be apparent that other types of sensors may be used in substitution for the latter specific sensors. Signals from normally-open sensors 35, 34 and 32 (i.e., or zones 1–3 respectively) are inputted to the alarm's first false alarm protection circuit 213 (FIGS. 7, 9) via lines 210, 211, and 212 emanating from connector 214 (i.e., as seen in the lower left portion of FIG. 7). Lines 210–212 respectively lead to inverters 218, 219 and 222 that output to AND gates 224 (FIG. 7) and 226 (FIG. 9). Inverters 218, 219 and 222 establish negative logic; all inputs and outputs of AND gates 224 and 226 are normally high. Gate 224's output goes low when either a responsive zone 1 or zone 2 signal is present on one or both of its inputs, which occurs when the monitored sensors 35 and/or 34 "open." Either the output of AND gate 224 on line 225 or a signal from zone 3 inverter 222 on line 227 must drop (i.e., go low) for AND gate 226 to go low on lines 229, 230 (FIG. 9). If any sensor opens, OR gate 234 activates a one-shot multivibrator 236 (FIG. 9) through R/C network 235, inverter 237, and R/C network 238. Multivibrator 236 functions as a trigger; it operates timer 239 by outputting a negative-going pulse to timer pin 2 via resistor 240 and lines 241 and 242 (FIG. 9). NAND gate 303 provides an alarm trigger pulse on lined 241 and 242 (FIGS. 9, 11). In FIG. 9 the pulse is represented at test line 305.

Timer 239 (FIG. 9) establishes a 3.5 to 4.5 minute timing interval during the detected or alarm mode. Timer 239 outputs on line 119 via node 244 to activate transmitter 114 (FIG. 5) discussed earlier. Timer 239 also outputs on node 244 and line 246 (FIGS. 7, 9), through resistor 248 to activate a solid state switch 249 (i.e., preferably a transistor, seen at the left FIG. 7) which in turn outputs on line 252 through connector 253 to activate audio transducer 254 (FIG. 7), which is preferably a 100 db siren. This siren can only activate when relay contacts 256 (i.e., a first audible alarm control means) and transistor switch 249 (i.e., a second audible alarm control means) are appropriately activated.

Power is applied to the transducer from power line 46 (FIGS. 3, 7) via relay contacts 256 and line 257 (FIG. 7). Relay coil 258 is directly switched on by any one of a trio 215 (FIG. 7) of transistors that respectively connect to lines 210, 211, and 212 via lines 216, 217, and 221. Resistors 209 forward bias transistors 215 (FIG. 7) unless shorted by zone lines 210, 211, or 212. Transistor 203 latches the relay coil 258. Transistors 215 prepare the alarm transducer 254 for firing by activating relay coil 258 to close contacts 256 whether the alarm is armed or not. However, the intelligent false alarm protection circuit 213 ultimately makes the decision to sound an alarm by controlling transistor 249 (FIG. 7). For the alarm to sound, two events must occur simultaneously; i.e., power must be applied on line 257 (from contacts 256), and a control signal must appear on line 246 (FIGS. 7, 9) to activate transistor 249. This preferred arrangement makes it more difficult for a false alarm to occur in response to a line voltage transient, a power surge or the like.

Timer 239 (FIG. 9) also activates multivibrator 260 that is formed by NAND gates 261, 262 (FIG. 9), and which drives inverter 265 to output on line 266 (FIGS. 6, 8, 9). Inverter 265 drives inverter 270 to output on line 272. Lines 266 and 272 deliver signals identified respectively as "Control 1" and "Control 2" in FIG. 11 which are 180 degrees out of phase. Line 266 leads to gate 161 (FIG. 8), and it connects via line 267 (FIGS. 6, 8) to AND gate 182 (FIG. 6) previously discussed. Gate 182 controls timer 188 via line 186 (FIGS. 6, 8). The CONTROL2 signal from inverter 270 is applied via line 272 (FIGS. 6, 8, 9) to NOR gate 177 (FIG. 6), AND gate 184 (FIG. 6), and NAND gate 204 (FIG. 8). Gate 184 outputs on line 276 (FIG. 6, 7) to turn timer 200 (FIG. 7) "on." Timer 200 connects to NOR gate 192 via line 202 (FIGS. 7, 8) which outputs on line 193 connected to circuitry discussed previously that controls RED display LED 38 discussed previously. This results in rapid blinking of the RED LED when an intrusion is detected. At this same time, since NAND gate 204 (FIG. 8) also responds to line 272, it forces green LED display indicator 37 to rapidly switch on and off, via line 205 that goes to gate 163 previously described.

Line 272 (FIGS. 8, 9) is connected to line 274 (FIGS. 8, 9) that connects to one side of a NAND gate 275 that outputs to NAND gate 277. The other input to gate 275 occurs via line 279, that leads to a reset circuit 281 activated by hardware reset switch 283 (FIG. 8) that is mechanically located within the interior 16 of cabinet 11 (FIG. 1). The low output of gate 277 appearing on line 289 (FIG. 9) resets timer 239 on pin 4 and multivibrator NAND gate 262.

The purpose of reset circuit 281 (FIG. 8) is to switch the alarm from the detected mode to the idle mode. Reset can be accomplished with hardware switch 283 (FIG. 8), preferably hidden within the cabinet 11, or with a remote control key fob 21 (FIG. 2). Line 291 (FIGS. 2, 6, 8) goes high from reset circuit 285 (FIG. 8) and resets key fob demodulator 155. The remote key fob operates receiver 112 (FIG. 4) causing receiver IC 120 to output on pin 3 via line 284 (FIGS. 4, 8) that activates reset circuit 281 (FIG. 8) without any delay, to return to the idle mode. The hardware reset switch 283 (FIG. 8) is hidden within the cabinet 11. If per chance a thief knows of its location within cabinet interior 16 (FIG. 1), a delay circuit 285 (FIG. 8) prevents the alarm from immediately switching back to idle mode by delaying reset circuit 281 (FIG. 8). Delay circuit 285 (FIG. 8) does not respond to remote "reset" signals on line 284 from receiver IC 120 (FIG. 4) that are transmitted remotely by the key fob 21 (FIG. 2).

To prevent initial arming of the alarm (and/or to prevent the warning buzzer from sounding) during service and maintence, a trio of zone-monitoring diodes 280 (FIG. 7) are employed to disable NOR gate 177 (FIG. 6) via line 282 (FIGS. 6, 7).

As mentioned above, the prevention circuit 213 (FIG. 9) has been designed to minimize false alarms. Attention is directed to the top of FIG. 9, wherein a second false alarm prevention circuit 291 is shown. Protective diodes 292 and 294 have cathodes connected to timer 239 to prevent it from responding to voltage transients. The anode of protective diode 292 is connected via lines 229 and 230 to OR gate 234. The anode of protective diode 294 is connected via line 295 to the output of NAND gate 296 (FIG. 9). One input of NAND gate 296 leads via line 298 to a wave shaping circuit 299 comprising a diode and a pair of resistors. The other input to NAND gate 296 is connected via line 179 to inverter 300 and NOR gate 234 (FIG. 9). The output from NAND gate 178 (FIG. 6) is also received via line 179 and delivered to inverter 300. Pin 2 (i.e., line 242) of timer 239 must go negative to set off the alarm, which is accomplished by the output of trigger 236 (FIG. 9). However, protective diodes 292 and 294 must both be "off" for the timer 239 to be able to respond to multivibrator 236. The "off" condition can take place for approximately 20 milliseconds only in the "armed" mode when any zone is being disturbed, as detected by sensors 32, 34 and/or 35.

Timing

Turning to FIG. 11, preferred timing considerations have been graphically depicted by the chart 340. There are three separate alarm states or operating conditions, comprising an "Idle Mode" represented by graph segment 342, an "Armed Mode" designated by segment 343, and a "Detected Mode" whose timing conditions are seen in segment 344.

In the idle mode, machine service and maintence is enabled. Lines 211, 212, and 210 (FIGS. 6, 7, 11) connecting to the various door and vibration sensors can be opened or closed as indicated by trace 345. Multivibrator 236 (FIG. 9) will be low at this time as seen by trace 346, and the trigger pulse on line 305 (FIG. 9) is represented by graphical segment 348. Voltage at the anodes of protective diodes 292 and 294 (FIG. 9) in the second false alarm prevention circuit will vary as seen by segments 350, 352. The CONTROL1 signal on line 266 (FIGS. 8, 9) is designated by reference numeral 354 in the idle mode; the CONTROL2 signal on line 272 (FIGS. 8, 9) designated by reference numeral 355 is generally 180 degrees out of phase. Reset lines 284 (FIG. 8) and 279 (FIG. 9) correspond generally to traces 356 and 357 (FIG. 11).

In the armed mode indicated by segment 343 of FIG. 11, the alarm is "set" and it is watching for an intrusion. Lines 211, 212, and 210 (FIGS. 6, 7, 11) connecting to the various door and vibration sensors produce a quiescent signal as indicated by trace 360. Multivibrator 236 (FIG. 9) will be low at this time as seen by trace 362, as will the trigger pulse on line 305 (FIG. 9) as represented by graphical segment 364. Voltage at the anodes of protective diodes 292 and 294 (FIG. 9) in the second false alarm prevention circuit will be high and low as seen by graphical segments 366, 368. The CONTROL1 signal on line 266 (FIGS. 8, 9) will continue high as designated by reference numeral 370. The CONTROL2 signal on line 272 (FIGS. 8, 9) designated by reference numeral 372 continues to be 180 degrees out of phase. Reset lines 284 (FIG. 8) and 279 (FIGS. 8, 9) correspond generally to traces 374 and 376 (FIG. 11).

A vertical dividing line 379 separates the armed mode from the detected mode; the graphical transitions between timing and the various signal states indicates an intrusion. In other words, the detected mode indicated by segment 344 of FIG. 11 indicates that the alarm is responding to an intrusion. Lines 211, 212, and 210 (FIGS. 6, 7, 11) connecting to the various door and vibration sensors produce a warning signal indicated by trace 380; after timers function they may produce different signals 381, 382. Multivibrator 236 (FIG. 9) will exhibit trace 384, and the trigger pulse on line 305 (FIG. 9) is represented by segment 386. Voltage at the anode of protective diode 292 (FIG. 9) in the second false alarm prevention circuit will first be low as seen by graphical segments 388, but at transition point 387 (i.e., when the door is closed after opening as illustrated by graphical segment 381 in FIG. 11) the voltage rises as indicated by trace 389. The voltage at the anode of protective diode 294 (FIG. 9) in the second false alarm prevention circuit will be high as seen by trace 392, and will drop as seen by trace 393. The CONTROL1 signal on line 266 (FIGS. 8, 9) will drop as designated by signal trace 396. The CONTROL2 signal on line 272 (FIGS. 8, 9) designated by reference numeral 398 goes high. Reset lines 284 (FIG. 8) and 279 (FIGS. 8, 9) correspond generally to traces 400, 402 (FIG. 11).

The negative-going trigger pulse 305 (FIG. 9) is represented by traces 348 and 364 in FIG. 11. However, means are provided to prevent a similar trigger pulse generated by noise, lighting or other bad line conditions from triggering the alarm. The false-alarm prevention diodes 292, 294 (FIG. 9) prevent the alarm from firing if either one is forward biased. Noting traces 350, 352 (FIG. 11) the alarm cannot go off. When for example, a door is opened, during the armed mode, indicated by vertical line 377, time period T1 begins, as indicated by arrows 406. At this crucial time, indicated by graphical region 411, both diodes 292, 294 are "low" as indicated by time period T4 arrows 412. For period T4 indicated by arrows 412 (FIG. 11) diodes 292 and 294 are both back-biased. Within period T4 after delay T1 pulse 305 occurs (line 386) during a period of time T2 indicated by arrows 409, to operate timer 239 (FIG. 9).

Operation

The alarm can assume three operational modes, referred to as the "Idle," "Armed," and "Detected" modes. The idle mode is the default occurring automatically when power is applied and the apparatus is first energized. The idle mode is indicated by the green indicator LED 37 which is continuously "on." Referring to FIG. 12, pressing the appropriate button 312 on key fob 21 initiates the "Armed mode" which is indicated by blinking of the red indicator LED 38. Button 311 (FIG. 12) establishes the idle mode. The armed mode is possible only when door is closed (i.e., the sensors 32, 34, 35 are not triggered). Remote key fob reset is achieved with button 313. Orifice 309 is for miscellaneous car keys. An alarm switches state between the "armed mode" and the "detected mode" in response to triggering of any sensor 32, 34, 35, as when the door opens or the unit is physically vibrated or pounded.

In the detected mode the buzzer 254 (FIG. 7) goes on and both LEDs 37, 38 light. The buzzer sounds for approximately four minutes and then goes OFF. LEDs 37 and 38 continue to blink with disregard of the status of the doors (doors can be left open or closed). Any further intrusion causes the buzzer to again sound an alarm for four minutes. The only way to return the system to the default mode is to reset it. There are two ways to reset, either with the key fob 21 or the hidden reset switch 283 (FIG. 8).

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A vending machine comprising:

an upright cabinet adapted to be disposed upon a supporting surface, the cabinet comprising an interior for housing vending machine components and items to be vended;

power supply means for supplying power;

a door coupled to the cabinet that may be opened or closed by a proprietor to expose or close the interior; and, an alarm mounted within said cabinet interior for detecting attempted theft and vandalism, the alarm comprising:

door sensor means for providing a signal in response to door opening;

vibration sensor means for providing a signal in response to vibration or shock;

audio transducer means for generating a loud audible sound;

visual transducer means for providing a highly visible indication of the state of the alarm, said visual transducer means comprising at least two status lights of different colors;

alarm circuit means for establishing an idle mode for machine servicing, an armed mode in which the alarm is set during normal operation, and a detected mode occurring when an act of vandalism or theft is properly detected, said circuit means comprising:

means for receiving and analyzing the signals from said door sensor means and said vibration sensor means; and, means for activating said audio transducer means; and, means for activating said visual transducer means in response to a proper detection of intrusions comprising means for differently activating said lights of different colors according to the mode of the alarm.

2. The vending machine as defined in claim 1 further comprising means for:

(a) in the idle mode, turning a first status light "on" while a second status light is "off";

(b) in the armed mode, turning on and blinking a second status light while a first status light is "off;" and, (c) in the detected mode blinking both said first and second status lights to indicate detection of acts of vandalism or theft.

3. The vending machine as defined in claim 1 wherein said alarm circuit means comprises a receiver that responds to a portable key-fob unit that an attendant may carry.

4. The vending machine as defined in claim 2 wherein said alarm circuit means comprises a transmitter for remotely relaying detected mode alarm conditions and status to a central location.

5. The vending machine as defined in claim 1 including a battery backup system comprising:

a battery;

recharging circuit means for trickle charging the battery, the recharging circuit means comprising means for determining when battery voltage has dropped to the point where trickle charging is necessary; and, a recharge-prevention circuit for preventing recharging when battery voltage is too low for trickle charging.

6. The vending machine as defined in claim 5 including charge indicator means for monitoring battery status, said indicator means comprising:

means for indicating when "on" that the backup battery is charging; and, means for indicating when "on" that the battery is properly charged and when "off" that the battery cannot be trickle charged.

7. The vending machine as defined in claim 1 wherein said visual transducer means comprises a green status light, a separate red status light.

8. The vending machine as defined in claim 7 further comprising means for:

(a) in the idle mode, turning said green light "on" while said red light is "off";

(b) in the armed mode, turning on and blinking said red light while said green light is "off;" and, (c) in the detected mode blinking both said red light and said green light to indicate detection of acts of vandalism or theft.

9. The vending machine as defined in claim 1 wherein said alarm circuit means comprises:

a key fob demodulator responding to said receiver for activating said status lights;

an armed mode timer for controlling the second status light;

first gate means for activating the armed mode timer;

a detected mode timer for delaying said alarm activation circuit;

second gate means for activating the detected mode timer; and, third gate means responsive to said armed mode timer and said detected mode timer for flashing said status lights when an intrusion is detected.

10. The vending machine as defined in claim 9 wherein:

said audio transducer means for generating a loud audible sound is powered by a relay means responsive to a relay field;

a first audible alarm control means directly responds to inputs from said door sensors means and said vibration sensor means to activate said relay field; and, a second audible alarm control means comprising a controlling switch connected to said audio transducer means responds to a control signal that activates said transducer means after switching of said relay means.

11. The vending machine as defined in claim 9 further comprising a first false alarm protection circuit comprising a timer for generating said control signal to activate said second audible control means.

12. The vending machine as defined in claim 11 further comprising a second false alarm prevention circuit comprising protective diodes connected to said timer to prevent it from responding to voltage transients.

13. A vending machine comprising:

an upright cabinet adapted to be disposed upon a supporting surface, the cabinet comprising an interior for housing vending machine components and items to be vended;

power supply means for supplying power;

a door coupled to the cabinet that may be opened or closed by a proprietor to expose or close the interior;

an alarm mounted within said cabinet interior for detecting intrusions, said alarm establishing an idle mode for machine servicing, an armed mode for normal operation, and a detected mode occurring when an intrusion is detected, said alarm comprising:

door sensor means for providing a signal in response to door opening;

vibration sensor means for providing a signal in response to vibration or shock;

audio transducer means for generating a loud audible sound;

visual transducer means for providing a highly visible indication of the state of the alarm, said visual transducer means comprising a first status light and a second status light mounted on the cabinet and externally visible to customers;

door sensor means for providing a signal in response to door opening;

vibration sensor means for providing a signal in response to vibration or shock;

audio transducer means for generating a loud audible sound;

visual transducer means for providing a highly visible indication of the state of the alarm, said visual transducer means comprising a first status light and a second status light mounted on the cabinet and externally visible to customers;

first alarm circuit means for activating said audio transducer means;

second alarm circuit means for activating said visual transducer means by a) in the idle mode, turning said first status light "on" while said second status light is "off";

(b) in the armed mode, turning on and blinking said second status light while said first status light is "off;" and, (c) in the detected mode, blinking both said first and second status lights to indicate detected intrusions.

14. The vending machine as defined in claim 13 wherein said second alarm circuit means comprises:

a key fob demodulator responding to said receiver for activating said status lights;

an armed mode timer for controlling the second status light;

first gate means for activating the armed mode timer;

a detected mode timer for providing a delay;

second gate means for activating the detected mode timer; and, third gate means responsive to said armed mode timer and said detected mode timer for flashing said status lights when an intrusion is detected.

15. The vending machine as defined in claim 14 further comprising a first false alarm protection circuit comprising a timer for generating a control signal to activate said first alarm circuit means for activating said audio transducer means.

16. The vending machine as defined in claim 15 further comprising a second false alarm prevention circuit connected to said timer to prevent it from responding to voltage transients.

17. The vending machine as defined in claim 13 further comprising:

a backup battery;

recharging circuit means for trickle charging the battery, the recharging circuit means comprising means for determining when battery voltage has dropped to the point where trickle charging is necessary; and, a recharge-prevention circuit for preventing recharging when battery voltage is too low for trickle charging.

18. The vending machine as defined in claim 17 including charge indicator means for monitoring battery status, said indicator means comprising:

a red light to indicate when "on" that the backup battery is charging; and, a green light that indicates when "on" that the battery is properly charged and when "off" that the battery cannot be trickle charged.

19. A vending machine comprising:

an upright cabinet adapted to be disposed upon a supporting surface, the cabinet comprising an interior for housing vending machine components and items to be vended;

power supply means for supplying power;

a door coupled to the cabinet that may be opened or closed by a proprietor to expose or close the interior;

an alarm mounted within said cabinet interior for detecting intrusions, said alarm establishing an idle mode for machine servicing, an armed mode for normal operation, and a detected mode occurring when an intrusion is detected, said alarm comprising:

door sensor means for providing a signal in response to door opening;

vibration sensor means for providing a signal in response to vibration or shock;

audio transducer means for generating a loud audible sound;

visual transducer means for providing a highly visible indication of the state of the alarm, said visual transducer means comprising a first status light and a second status light mounted on the cabinet and externally visible to customers;

first alarm circuit means for activating said audio transducer means;

second alarm circuit means for activating said visual transducer means, said second alarm circuit means comprising:

an armed mode timer for controlling the second status light;

first gate means for activating the armed mode timer;

a detected mode timer for delaying said second alarm circuit means;

second gate means for activating the detected mode timer; and, third gate means responsive to said armed mode timer and said detected mode timer for flashing said status lights when an intrusion is detected.

20. The vending machine as defined in claim 19 further comprising:

a first false alarm protection circuit comprising a timer for generating a control signal to activate said first alarm circuit means for activating said audio transducer means; and, a second false alarm prevention circuit connected to said timer to prevent it from responding to voltage transients.

* * * * *